340-554
11/9/82 SR
KR 4,358,756

United States Patent [19]

Morel et al.

[11] 4,358,756

[45] Nov. 9, 1982

[54] ALARM TRANSMISSION SYSTEM

[75] Inventors: Pierre A. A. A. Morel, Saint Mande; Marc P. L. Pittavino, Santeny, both of France

[73] Assignee: Agence Centrale de Services (ACDS), France

[21] Appl. No.: 160,580

[22] Filed: Jun. 18, 1980

[30] Foreign Application Priority Data

Jun. 26, 1979 [FR] France ..... 79 16431

[51] Int. Cl.[3] ..... G08B 13/00

[52] U.S. Cl. ..... 340/539; 340/521; 340/524; 340/554; 340/825.7

[58] Field of Search ..... 340/207 P, 207 R, 521, 340/523, 524, 531, 539, 541, 546, 554, 560, 825.7

[56] References Cited

U.S. PATENT DOCUMENTS 3,869,669 3/1975 Eldert et al. ..... 375/45
3,909,826 9/1975 Schildmeir et al. ..... 340/539
4,247,846 1/1981 Zedler ..... 340/539

FOREIGN PATENT DOCUMENTS 2234622 1/1975 France .
2281612 3/1976 France .

OTHER PUBLICATIONS

Wigger; "Remote Radio Alarm Systems"; May/Jun. 1968; 8 pp.
Jackson; "Portable RF Alarm Link System"; Apr. 1977; pp. 218–220.

*Primary Examiner*—Alvin H. Waring
*Attorney, Agent, or Firm*—Ostrolenk, Faber, Gerb & Soffen

[57] ABSTRACT

An alarm transmission system with portable receivers for watching a site, which system comprises a plurality of portable and removable autonomous detection units, a plurality of portable autonomous receiving modules capable of releasing signalling or warning means incorporated to the said receiving modules upon receipt of signals sent by a transmission unit and a central information-receiving and processing unit equipped with at least one receiving module, and in which system the signal transmission unit is constituted on the one hand by radio-transmission and coding means associated to each detection unit and on the other hand by means of reception by radio-link and decoding means incorporated to each portable receiving module.

13 Claims, 9 Drawing Figures

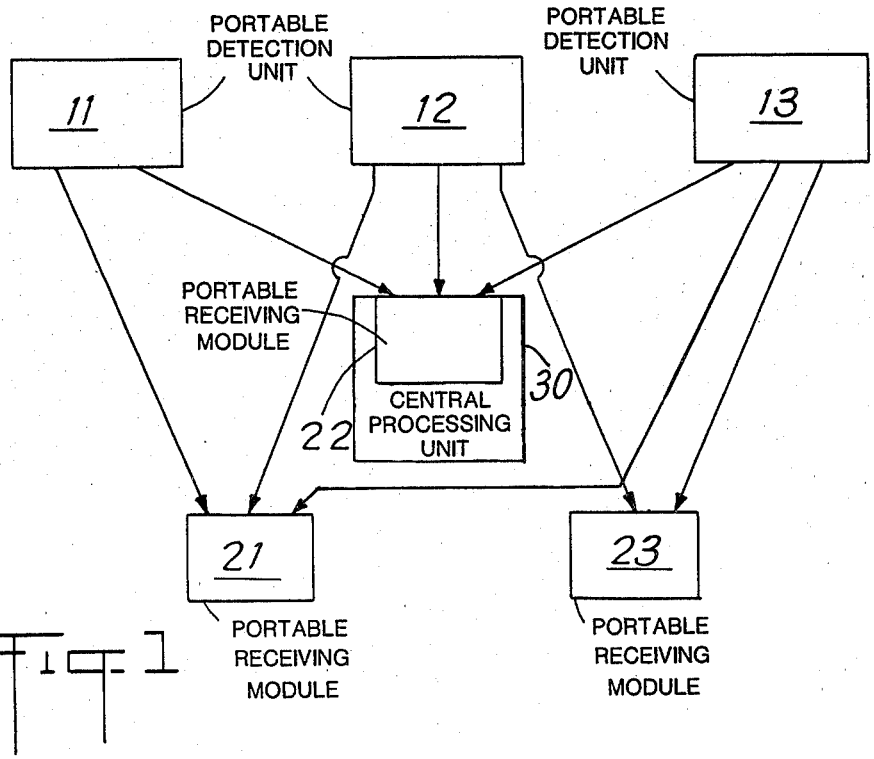
FIG. 1
FIG. 4
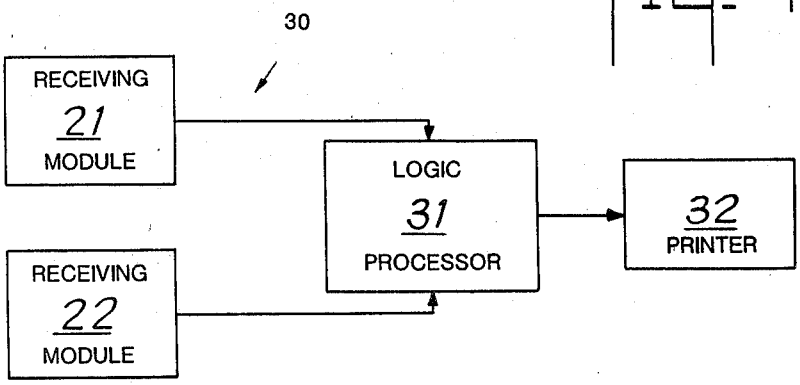

CK
TK
CE
TE
MB
Z2 D2 D1 D0 U3 U2 U1 U0 A1 A0 P
DEC
Sy

ALARM TRANSMISSION SYSTEM

BACKGROUND OF THE INVENTION

The present invention relates to an alarm transmission system, comprising at least a detection unit, equipped with detectors capable, when energized, of delivering electrical signals, a signal transmission unit for transmitting the signals sent by the detection unit or units, and at least one receiver remote from the detection unit, for receiving the signals transmitted by the transmission unit.

Numerous systems are known which are intended for detecting any change occurring in the environment where a detector is located and for triggering an alarm in a spot remote from where the detector is located. Such systems generally require a transfer of information by telephone. The signals sent by the detectors when these are energized, are transmitted in coded form by telephone wires connected to a central monitoring station. Such systems, which are relatively complex, do not permit an instant intervention on the spot where an anomaly is detected, due to the necessity of an entirely centralized transmission by telephone. Moreover, the detectors need to be installed in a fixed station.

It is also known to equip detectors with radio-link transmission means for remotely transmitting an alarm signal. Such detectors, which are also fixedly installed, generally have a poor transmission range and can only transmit a signal to a receiver situated in the immediate vicinity of the detector, without permitting the centralizing or identifying of the information sent when several detectors installed apart from one another are used.

It is also known from French Patent No. 2 234 622 and from its first Patent of Addition No. 74 27 456 to use a telemonitoring system wherein a central unit, mounted in a vehicle, can be successively in contact with permanent peripheral units equipped with emitting receiving means. Such a system however is limited in versatility due to the fact that there is only one central unit which can be connected to the different peripheral units and that the latter can only send information if they are actively urged, this actually implying that they are themselves equipped with radio reception means.

It is precisely the object of the present invention to overcome these disadvantages and to propose an alarm monitoring and transmission system which is particularly easy to install and permits both to centralize the information supplied by the different detectors used and to ensure the reception of the information sent by the detectors from mobile receiving points situated at varying distances from the monitored zones.

A further object of the invention is to produce an alarm monitoring and transmission system which is entirely autonomous and independent of the environment to be watched, permitting an overall monitoring whilst increasing the reliability of operation and the rapidity of intervention when an alarm is released.

BRIEF DESCRIPTION OF THE INVENTION

These objects are reached with an alarm transmission system of the type mentioned at the beginning which, according to the invention, comprises a plurality of removable and portable, autonomous detection units, a plurality of autonomous receiving modules, portable and capable of triggering off signalling or alarm means incorporated to the said receiving modules when the signals transmitted by the transmission unit, are received and a central unit receiving and processing information, which is equipped with at least one receiving module, the signal transmission unit further comprising, on the one hand, coding and radio-transmission means associated to each detection unit and, on the other hand, means of reception by radio-link and decoding means incorporated in each portable receiving module.

Such a teletransmission system with portable receivers constitutes a coherent unit for sending and receiving alarm signals, which unit is versatile and reliable and has a configuration preferably incorporating at least an electronic control against intrusion.

Such a system which, due to its autonomy, its succinct installation, its mobility and its radiofrequency transmission, permits a rapid and temporary intervention, and a change in the configuration of the protection in a minimum time, is adapted to operate on premises or blocks of buildings where the presence of security officers is necessary, such as for example, warehouses, industrial sites with multiple buildings, industrial, commercial or dwelling zones, blocks of flats, towers, museums, etc . . .

Various advantageous features of the special embodiments of the invention are given hereafter:

The radio link transmission comprises means for transmitting binary information by frequency modulation.

The modulated binary information signals comprise a first frequency representing the zero condition and a second frequency which is a whole multiple of the first frequency and represent the condition one.

Two signals corresponding to the condition one sent by two detection units placed in two different detection zones are whole multiples of the first frequency, which are different one from the other.

A strict phase relation is permanently kept between the carrier frequency and the binary information signal transmitted by the transmission means.

The transmitted binary information signal comprises at least elements that are representative of one detection zone, of the address of one unit in that detection zone and of a type of alarm release, as well as control elements for the transmitted signal, for controlling for example its parity.

Each detection unit comprises at least a volumetric detector of intrusion with Doppler effect.

Each detection unit comprises at least a perimetric intrusion detector.

Each detection unit comprises at least a fire detector.

Each detection unit comprises an operation-locking or timing means for said unit.

Each receiving module is equipped with means for selecting the detection zones which will only respond to those signals sent by detection units situated in very specific zones.

Each receiving module is equipped with release means for clearing the triggered display or alarm signal.

Each receiving module is in the form of a portable unit which can be plugged in the central unit, and is provided with all the control, display, and receiving aerial elements on a single face protected by a raised side edge and equipped with a gripping handle.

The central unit comprises a printer for recording the information received by at least one receiving module plugged in the unit, and means for controlling said information.

BRIEF DESCRIPTION OF THE DRAWINGS

The invention will be more readily understood on reading the following description with reference to the accompanying drawings, in which:

FIG. 1 is a diagrammatical view of the whole installation of the alarm transmission system according to the invention, FIG. 4 is a block diagram of a central receiving and processing unit in the transmission system according to the invention, FIG. 6 is a detailed diagram of one part of the detection unit shown in FIG. 2.

DETAILED DESCRIPTION OF THE DRAWINGS

Figure 2:
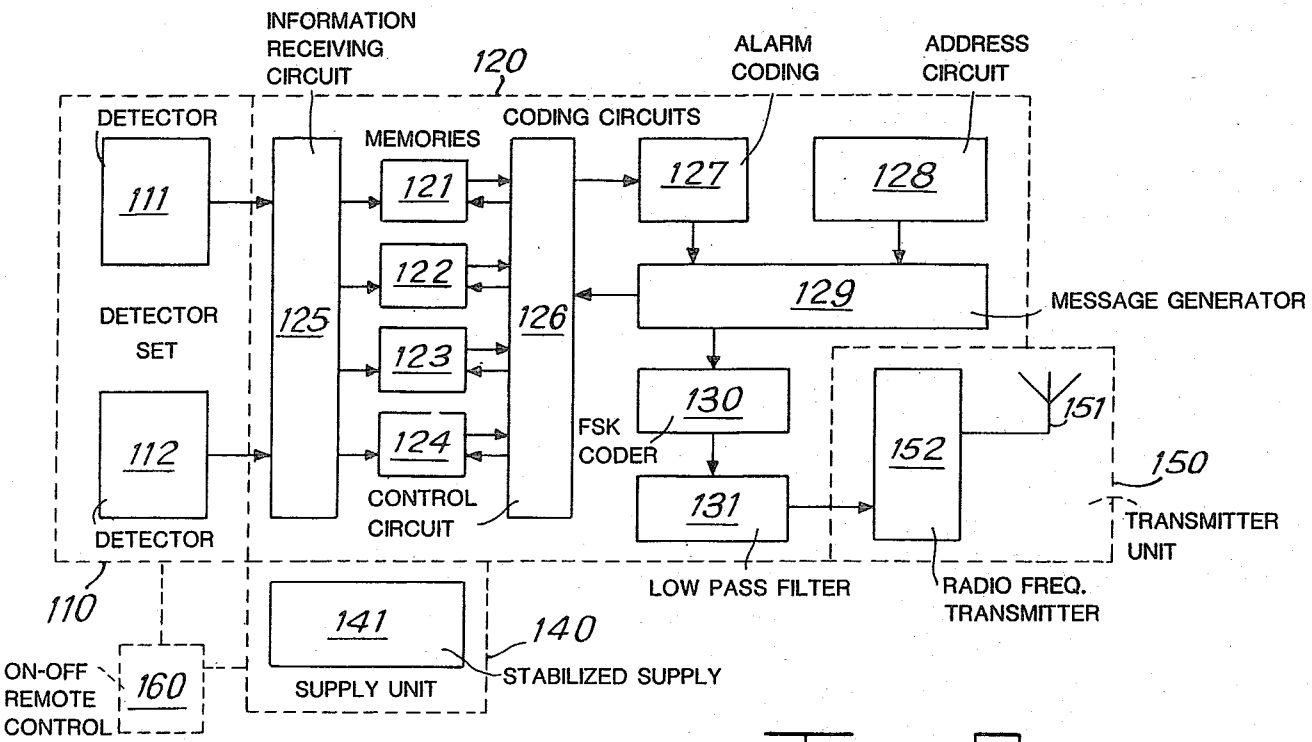
FIG. 2 is a block diagram of a detection unit in the transmission system according to the invention.

FIG. 1 gives a diagrammatical illustration of an alarm monitoring and teletransmitting system with portable receivers according to the invention.

Portable detection units 11, 12, 13 equipped with an autonomous power supply such as a chargeable battery, are entirely removable and can be installed in selected points of one or more zones to be watched. Each detection unit 11, 12, 13 is equipped with detectors and with an encoder-transmitter capable of sending in radio frequency a coded message giving the nature and point of origination of the alarm, when a detector has picked up a disturbance to which it can respond.

Portable and autonomous receiving modules 21, 22, 23, receive and display the signals sent by the detection units 11, 12, 13. Some receiving modules can be selective and respond only to information signals sent from specific zones. For example, in FIG. 1, the receiving module 23 only responds to signals sent by detection units 12, 13, whereas the receiving modules 21, 22 respond to the signals sent by detection units 11, 12, 13.

The receiving units 21, 23 of FIG. 1 are movable and are supposed to be carried by itinerant security officers whereas the receiving module 22, which can be perfectly identical to the modules 21 and 23, is plugged in a central processing unit 30 controlling and centralizing all the information sent by the detection units 11, 12, 13. The central processing unit 30 can itself be fixed or mobile depending on the site to be watched. For example, in the case of buildings or building blocks with ground surface permitting sufficiently rapid interventions from a security officer on foot, the central unit can be fixed. In the case of industrial zones, it can be mobile and installed in a vehicle of intervention.

The alarm teletransmission system shown in FIG. 1 can of course comprise a number of varying detection units 11, 12, 13 as well as receiving modules 21, 22, 23. However, the system is especially adapted to work with a large number of detection units in position in fixed points and a small number of mobile receiving modules carried by security officers. Indeed, the presence of a central control unit 30, and of receiving modules 21, 23 capable of circulating and passing successively in the field of action of the various detection units 11, 12, 13 ensure a virtually permanent control of the good operation of the different devices whilst permitting a rapid intervention on the location of an unauthorized alarm signal, as will be explained in more details hereinafter. The complete mobility of the different components of the system also permits a rapid setting up of the monitoring system, which can be for example removed during the day and set into place at night with renewed lay-outs.

Generally speaking, the system according to the invention is suitable for watching a site divided into zones, each zone being itself divided into a certain number of points, and each point being associated to a detection unit capable of sending a certain number of information.

By way of example, a monitoring system according to the invention can handle the centralization by radiolink of 2560 pieces of information sent from 640 detecting points distributed in 8 zones of 80 points each. Each receiving module which actually can be made selective so as to only take note of the information originated from certain specific zones, is thus capable of displaying four pieces of information of different nature originating from any one point of the zones considered.

FIG. 2 diagrammatically shows the different components of a detection unit such as 11, 12 or 13.

A set 110 of detectors such as 111, 112 can produce electrical signals in response to different types of disturbances. Thus, the detector 111 is advantageously a volumetric detector of intrusions which includes a microwave radar capable of detecting a movement occurring in its lobe. The detector 112 can be a perimetric detector of intrusion constituted by an open contact, a sismical detector or else a fire detection loop. Various types of detectors 111, 112 can also be incorporated to the detection unit 11 depending on the considered applications.

The unit 140 of FIG. 2 is a supply unit for the detection unit. The unit 140 has a stabilized supply 141 which is equipped with an autonomous battery, but can of course be also connected to a supply network.

The unit 160 of FIG. 2 is a remote control means for timing the ON and OFF operations of at least some of the detectors 111, 112.

The unit 120 of FIG. 2 corresponds to various electronic coding circuits necessary to record the information sent from the units 110, 160 and allow a binary coded message to be sent by the transmitter 150.

The circuit 125 receives different pieces of information sent by the units 110, 160, for example a signal sent by a volumetric detector of intrusion 111, a signal sent by a fire detector 112, information of operation starting or stopping sent by the unit 160. Such information is stored in memories 121 to 124 and controlled by the circuit 126 which grades the information in case of simultaneity, the circuit 126 being itself connected to the alarm coding circuit 127 which codes the nature of the information supplied by the circuit 126, and to the circuit 129 whose role is to generate a series message which records the information coded by the circuit 127 and the address supplied by the circuit 128 and corresponds to the coordinates of the point monitored by the detection unit. The circuit 130 ensures an FSK coding of the message to be transmitted and is connected via a low-pass filter 131 to a radiofrequency transmitter 152 provided with an aerial 151 and effecting a frequency modulation transmission in a UHF or VHF band.

The messages sent by the detection units 111, 112, 113 are picked up by at least one receiving module 22 situated in the central unit 30 and by one or more of the mobile portable receiving modules such as 21 or 23.

Figure 3:
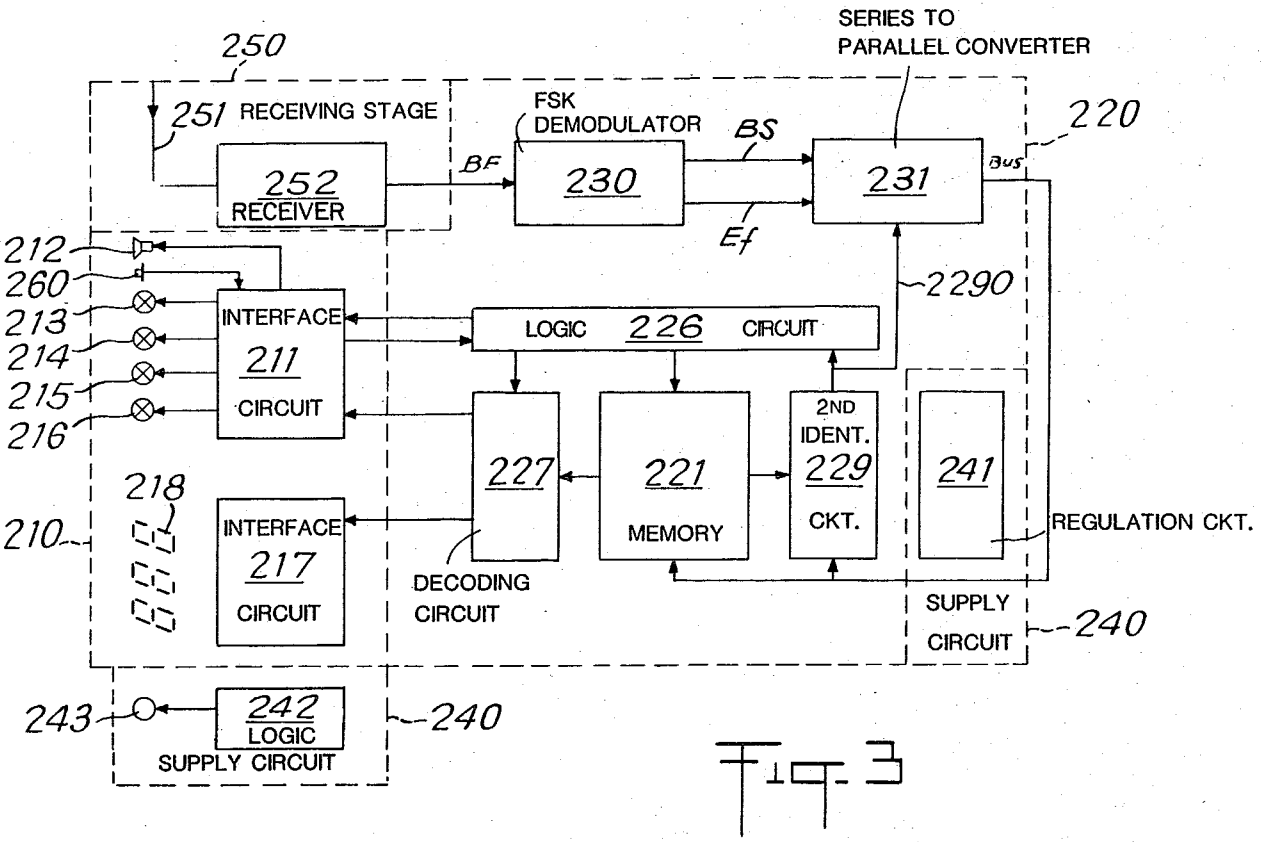
FIG. 3 is a block diagram of a receiving module in the transmission system according to the invention.

FIG. 3 shows the operational diagram of a portable receiving module which can be plugged in the central processing unit 30.

The receiving stage 250 of frequency modulated messages comprises a conventional radiofrequency receiver 252 provided with an aerial 251. The logical processor comprises an FSK demodulator circuit 230 ensuring the FSK decoding of the received message and supplying a binary coded message to the series-parallel conversion circuit 231, ensuring a first identification, and is connected to a memory 221 as well as to a circuit 229 of second identification permitting the reception and recording of a second message when a first series of information is already displayed. A locking signal can be applied to conversion circuit 231 from circuit 229 in a line 2290.

A logical circuit 226 transfers the information between the memory 221, the circuits 229, 231 and a decoding circuit 227 controlling the display of the information received.

The interface circuit 211 supplies power to the indicator lights 213 to 216 for displaying the nature of the alarms released, sent by the detection units 11, 12, 13 and picked up by the receiving module. A warning signal 212 is also controlled by the circuit 211 to signal any alarm received by the receiving module. With the push button 260 which is also connected to the circuit 211 it is possible to stop the display of the alarm and indicate that the displayed alarm signal had been duly noted by the user. A second interface circuit 217 ensures the display on the board 218 of the address of the point and of the zone corresponding to the detection unit which has sent the message picked up by the receiving module.

The supply circuit 240 comprises, in conventional manner, circuits 241 for stabilizing and controlling the supply by battery, and if necessary a logical circuit 242 supplying power to an indicator light 243 controlling the charging of the battery set into operation when the receiving module is used in a fixed station and is plugged in the central control unit 30.

FIG. 4 shows the block-diagram of an example of central processor 30 which can be used in combination with the portable detection units 11, 12, 13 and the portable receiving modules 21, 22, 23 to constitute a complete and centralized monitoring system.

The central control unit 30 comprises at least one receiving module such as 22 capable of receiving all the information sent by any one of the detection units 11, 12, 13 of the system. The receiving module 22 thus displays all messages received and in addition records each message on a printer 32 controlled via logical processors 31 of the central unit 30. Said central unit can of course be equipped with its own receivers distinct from the receiving modules such as 22 or 21.

Generally speaking, the central unit 30 ensures the reception of all messages sent by the detection units, which can correspond to an ON signal, to an alarm signal or to an OFF signal. The central unit can also operate automatically by recording and dating any information received. Finally the central unit advantageously ensures the re-charging of the batteries of the portable receiving modules which can be plugged in and operate either in fixed manner in combination with the central unit, or in an autonomous and mobile manner, when they are carried by walking users.

Figure 5:
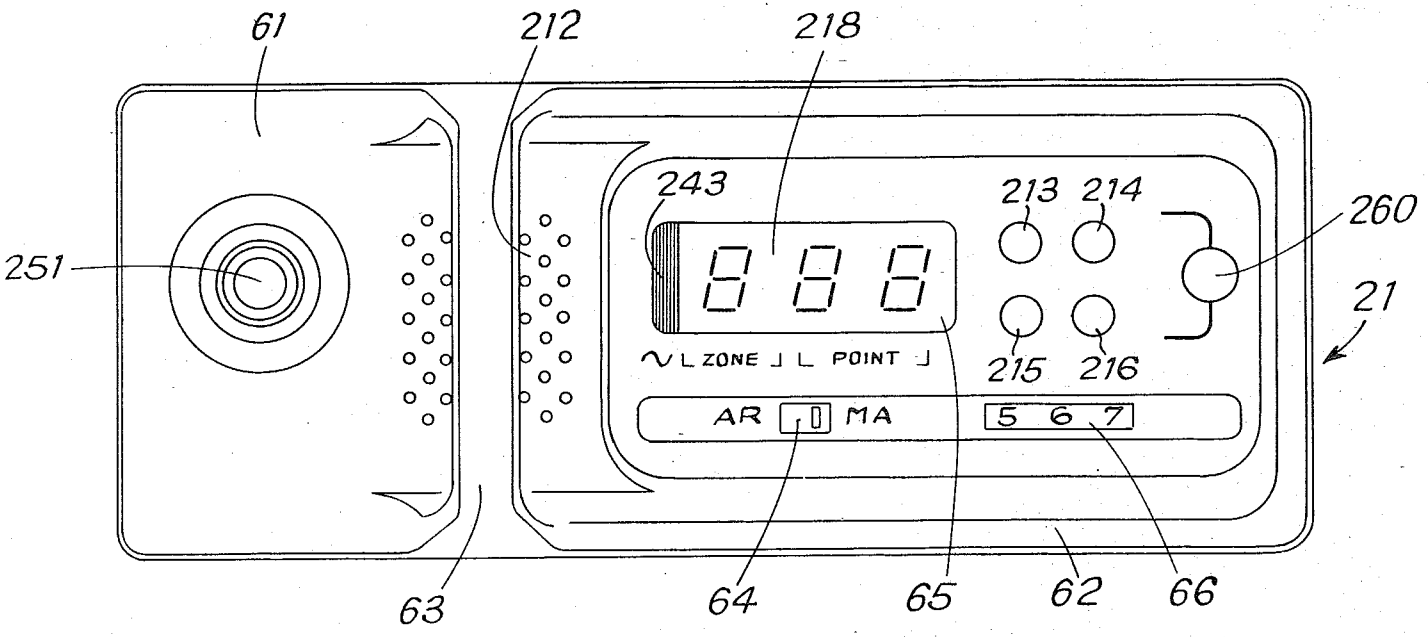
FIG. 5 is a view showing the front face of a receiving module according to the invention.
Figure 5:
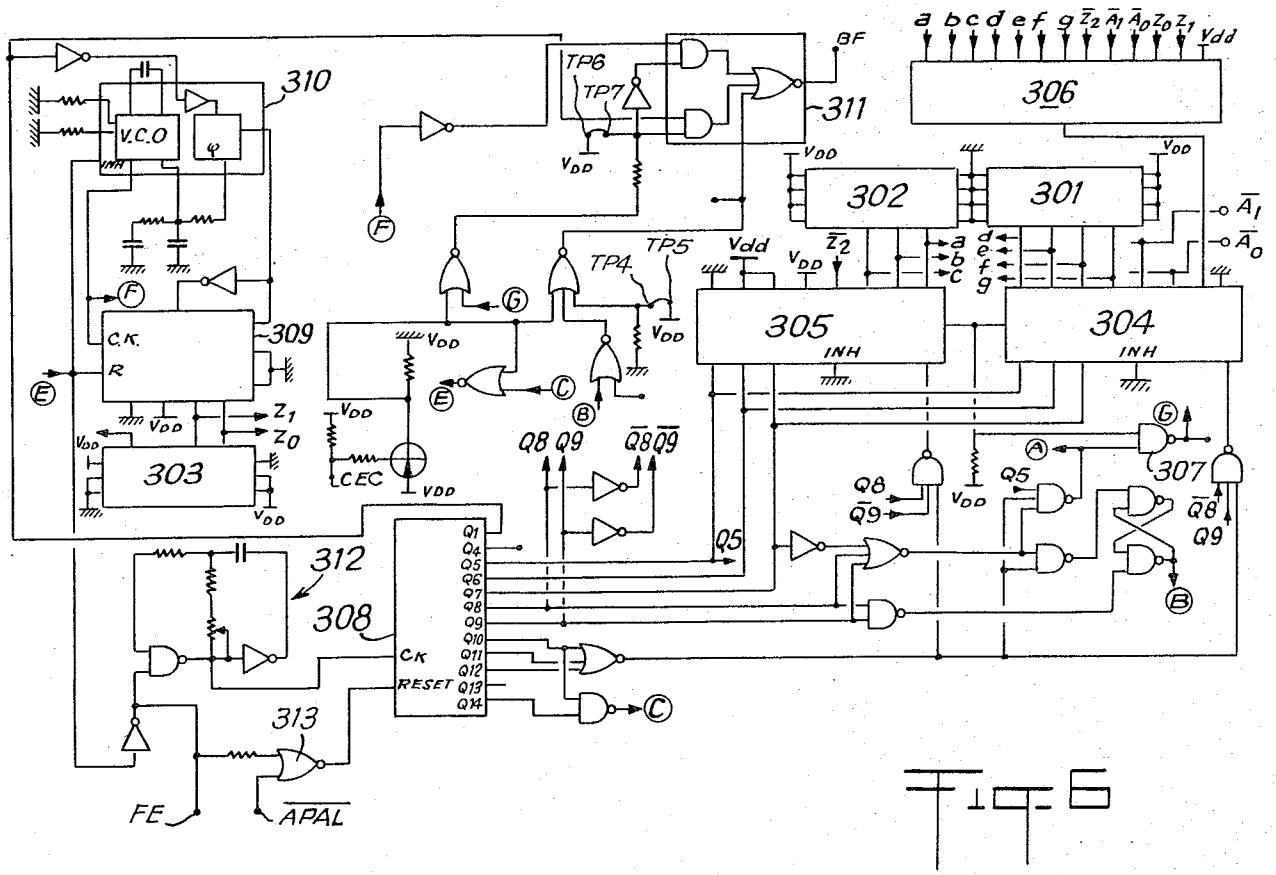

Even the shape of the receiving modules such as 21, which can be seen in FIG. 5, is adapted to the double function of these modules, which is to operate in a fixed station, or on their own. The various viewing, signalling or control elements such as the ON-OFF button 64, the operation finder 65, the zones-ON indicator 66, the indicator lights displaying the nature of the information received 213 to 216, the board 218 displaying the address of the point from where a message is sent, the release push button 260, charge control 243, the warning signal 212, the aerial 251, are all re-grouped on a single face 61 of the module 21 which can be built-in and portable. An outer peripheral raised edge 62 protects the signalling or control elements situated on the face 61 and a handle 63 helps to grip the built-in module 21.

It will be noted that the treble association of portable transmission-detection units operating in fixed stations, with mobile and portable receiving modules and at least one centralizing receiving module cooperating together contributes to combining and reinforcing the advantages of a watching service by localized detectors and human supervision in the form of rounds, whilst reducing the staff necessary, increasing the reliability of the supervision and improving the versatility of use of the different elements constituting the installation. Indeed, the presence of portable and autonomous detection units permits different localizations which can easily be changed inside the site to be watched; the availability of portable and autonomous receiving modules permits a direct control of the good operation of the detection units by the security officer whose duty it is, on his rounds, and by his successive presence by each detection unit equipped with an intrusion detector, to switch on each one of the said units and receive a message corresponding to the detection of his own presence in the area; and the centralizing receiving module permits to check the successive switching on of the different detection units tested in a predetermined order by the officer carrying a portable receiving module. Finally, owing to its response to the messages sent by a group of detection units, and to its capacity to identify instantly the origin of a message, a portable receiving module makes instant intervention possible in the case of unpredetermined alarm signals.

According to a special feature of the system according to the invention, which will be described with reference to FIGS. 6 to 9, the reliability of the transmission of messages between detection units and receiving modules is improved and the non-response to false alarms is increased, owing to the fact that there is a strict phase relation between the BD carrier frequency used to transmit the messages and the binary information signal constituted by a succession of elements of the same duration comprising for example either a frequency of 400 Hz to represent a condition zero, or a multiple frequency of 400 Hz, which can be dependent on the detection zone, for instance 2000 or 1600 Hz, to represent a condition one. In order to reduce the response to interference, an FSK modulation system is used in which a single clock is used for synchronizing frequencies defining the information signal.

Reference will now be made to FIG. 6, which corresponds to an example of embodiment of part of the circuits shown in FIG. 2, namely which show circuits incorporated to a detection unit to write a binary coded message and allow its transmission.

Rotary switches 301, 302, 303 permit the display in the detection unit of numbers representing a zone number (switch 303) and an address to identify the point where the detection unit is situated inside the said zone (switches 301 and 302 which, in the illustrated example, permit the display of a 7-bit number in binary form).

A double 8-bit multiplexer 304, 305 is connected in series to the switches 301, 302 to allow the generator of a series binary message.

Figure 8:
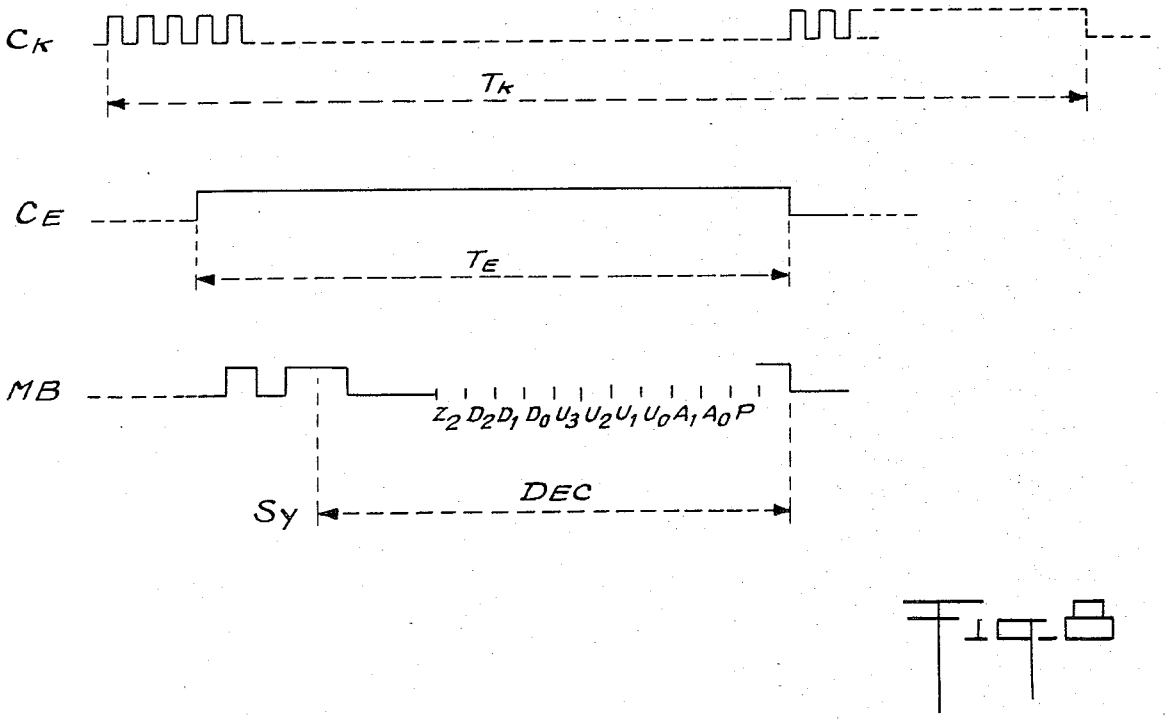

The binary message to be transmitted is, in the illustrated example, in the form shown in FIG. 8. The significant part of the message which is generated by the multiplexor 304, 305 comprises a bit $Z_2$ corresponding to a zone indication, bits $D_2$, $D_1$, $D_0$ corresponding to a tens number in the address identifying the point of transmission, bits $U_3$, $U_2$, $U_1$, $U_0$ corresponding to a unit number in the address identifying the point of transmission, and two bits $A_1$, $A_0$ corresponding to an indication of the nature of the alarm signal. The part of binary message transmitted and effectively decoded DEC further comprises a parity bit P, generated in the circuit 306, to which are applied the different aforesaid bits. The DEC message further comprises structure bits, namely in the case of FIG. 8, a first bit "1", followed by three bits "0", placed ahead of the message transmitted and effectively decoded DEC, and a bit "1" following the parity bit, at the end of the message effectively decoded DEC, which thus comprises 16 bits. The binary message MB is transmitted whilst the transmitter control is at condition "1", i.e. in the given example, for 400 milliseconds. The first bits of binary message MB, preceding the part which will be effectively decoded DEC comprise bits of random value and include one synchronizing bit SY.

At the output of the multiplexer 304, 305, the first four structure bits of the part DEC of the binary coded message are added to the bits signifying the message, at the level of the NAND gate 307 to form the binary signal G which constitutes a complete series binary message.

In order to reinforce the probability of good reception of the transmitted message, the latter is issued successively several times in a predetermined time interval $T_K$. For example, the coded message MB can be issued three times in succession in 10 seconds. It is the counter 308 (FIG. 6) which effects the sequencing and controls the appearance of the sequence control of transmission during which the output of the multiplexor 304, 305 will be associated to the structure bits in order to form the binary message MB. At the end of the predetermined time $T_K$, the clock is stopped by the output signal E, which produces an end of emission signal and the request for transmission is cleared due to the signal applied to the input of the clock $C_K$ of the counter 308. If an alarm then appears once more, a complementary signal APAL which equals "0" is present on an input of NOR gate 313, a signal is then applied to the clearing input of the counter 308 and the sequencing starts again to allow the transmission of a binary message for the predetermined number of time during said time $T_K$. Thus it will be noted that the clock only works during the transmission by which follows an alarm signal or a manual operation by the entry "continuous transmission control" CEG. This last entry permits to conduct tests by stopping the transmission of the message with a high frequency (for exmaple of 1600 Hz) corresponding to a bit value equal to "1" and permits to control the frequency of the inside clock as well as the high frequency used to convey the transmitted message.

The circuit 310 is constituted by a PLL circuit, i.e. a control phase loop, which is used to produce an FSK modulation, namely to produce a signal comprising a carrier whose frequency can correspond either to a predetermined lower frequency corresponding to a binary condition zero, or to a predetermined higher frequency corresponding to a binary condition one.

In the case of the circuit of FIG. 6, the higher frequency has the particularity of being a harmonic frequency of the lower frequency. Moreover, there is a lockout of the phase of a harmonic frequency representing the binary condition "1" and of the phase of the frequency representing the binary condition "0" (which equals 400 Hz in the described example). As a result, in the low frequency signal transmitted by the output circuit 311, there is no discontinuity when passing between two frequencies (see the form of the signal $TP_3$ in FIG. 9).

Thus, contrary to the case of the normal operation of a PLL circuit ensuring an FSK modulation, the circuit 310 is not directly controlled by the formed binary signal G, but said binary signal G is applied to the output switching circuit 311, to which are also applied, on the one hand a signal with low reference frequency (400 Hz) issued to represent a binary condition "0", and on the other hand, a signal F whose frequency is a whole multiple of the reference frequency (for example 1600, 2000, 2400 or 2800 Hz) and corresponds to the level "1". The programmable divider 309 which is associated with the switch 303 and to the PLL circuit 310 allows the formation of the harmonic frequency of the reference frequency (400 Hz), with a value dependent on the value of the bits $Z_0$, $Z_1$ displayed by the switch 303. For example it is thus possible to supply four different values of high harmonic frequencies (1600, 2000, 2400 and 2800 Hz) each one corresponding to a predetermined zone. The value of the high frequency will depend on the display obtained at the start in the switch 303. It is thus possible to obtain, from the value of the high frequency of the signal BF sent out, an indication relative to the zone in which the transmitting unit is situated. Of course, the indication relative to the reference zone can also be included in conventional manner in the binary message comprising the address coded $D_2$, $D_1$, $D_0$, $U_3$, $U_2$, $U_1$, $U_0$ of the localization of the transmitter in one zone, rather than be carried by the multifrequency system.

The low frequency oscillation (400 Hz) is used as phase reference for the circuit 310 and, by the comparison between the low frequency oscillation and the harmonic produced by the circuit 309, permits a phase lockout of the high frequency (for example 1600 Hz) and of the low frequency (400 Hz).

Generally speaking, according to the present invention, the coding of the signal BF between two frequencies is effected in the switching circuit 311, to which are applied the signal of reference frequency (400 Hz) at the input 9 and the signal of higher frequency (for example 1600 Hz) to the input 6, without any discontinuity appearing when the passage from one frequency to another is controlled by the binary signal G. For the whole circuit of FIG. 6, the generation of the reference frequency (400 Hz) and the rest of the sequencing are effected from one clock 312 which delivers pulses lasting 1.25 milliseconds to the counter/divider 308, so as to permit a thorough control of the transmitted message.

It is to be noted that in the diagram shown in FIG. 6, the connections between the terminals $TP_4$ and $TP_5$ for the HF control and between the terminals $TP_6$ and $TP_7$, for the reference frequency control (400 Hz), are only made to carry out tests and they do not take part to the normal working of the circuit.

Figure 9:
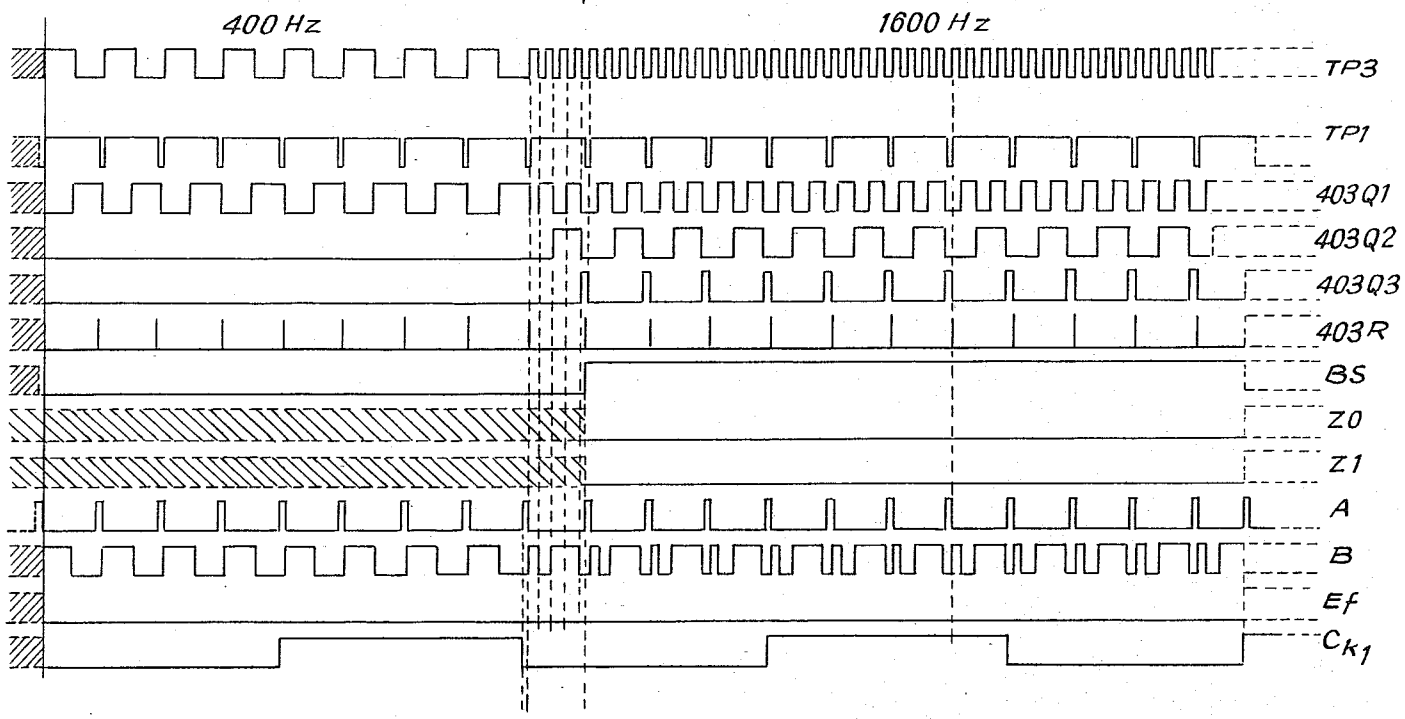

As can be seen in FIG. 9 (signal $TP_3$) the signal BF sent by a detection unit and picked up by a receiving module comprises a succession of binary elements of fixed duration (20 milliseconds in the illustrated example) which comprise an oscillation of 400 Hz (level "0") or multiple of 400 Hz (level "1"). In view of the absence of discontinuity during the passage from one binary element to another, the signal BF shows a vertical edge for each change of binary condition. Inside each binary element, bearing in mind the reference frequency selected ($f_o$=400 Hz), there must be a vertical edge every time period $t_o=1/f$, i.e. every 2.5 milliseconds. In relation to what, it will be possible, at reception to effect a frequency measurement every 2.5 milliseconds. In this case, if in the eight frequency checks that are carried out per binary element and for the sixteen binary elements of a message, a predetermined number of falling edges are not revealed, a clearing signal indicating a wrong identification of signal will clear the contents the series-parallel conversion register contained in the circuit 231 of the receiver (FIG. 3).

This way, the circuits of the receiver can keep a continuous check on the frequencies persent in the message, and thus eliminate all risk of releasing on non-transmitted interference signals of the transmission system.

There will now be described an example of decoding circuit such as included in a receiving module to process a signal BF received, of the type generated by the circuit of FIG. 6, which decoding circuit corresponds to the circuit 230 of FIG. 3.

Figure 7:
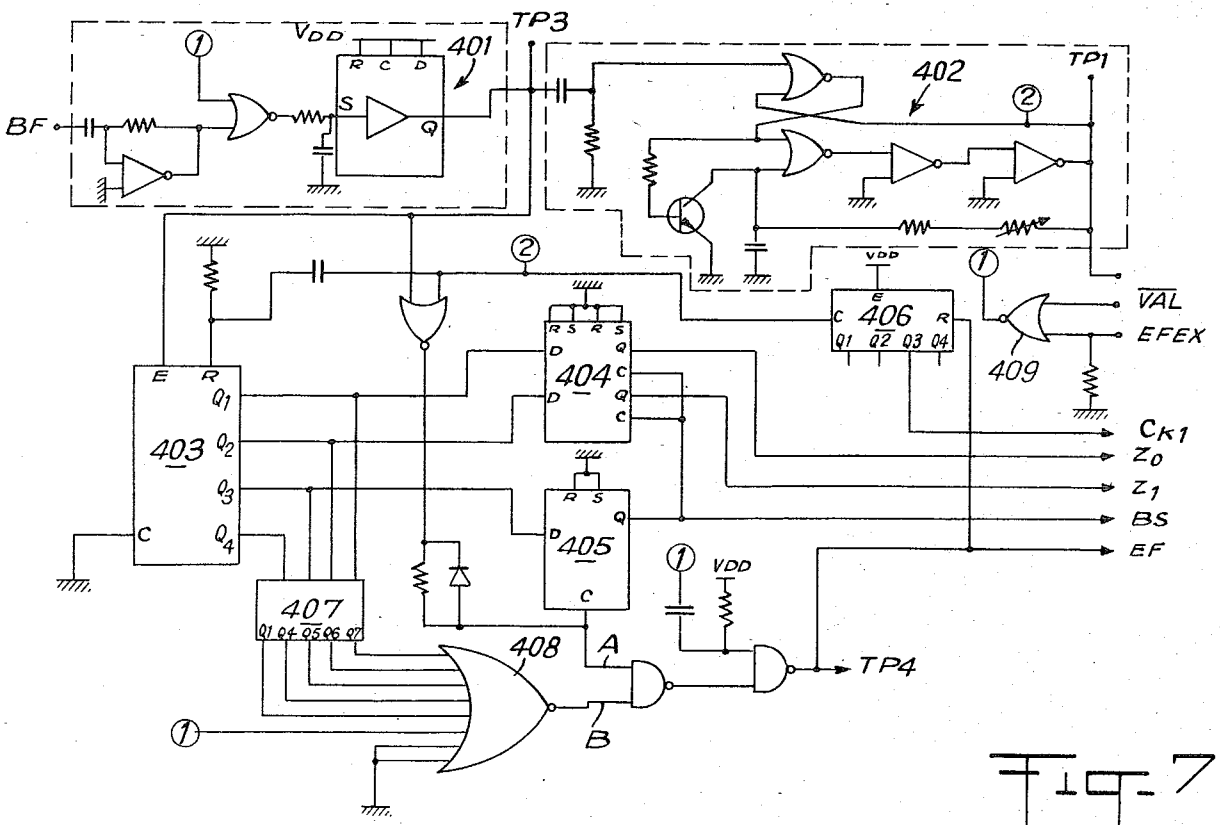
FIG. 7 is a detailed diagram of one part of the receiving module shown in FIG. 3, FIGS. 8 and 9 are diagrams of the signal times corresponding to points in the circuits of FIGS. 6 and 7 respectively.

In FIG. 7, the elements 401 are re-shaping elements for producing on the terminal $TP_3$ a BF signal which is in conformity with the transmitted signal, that is to say formed of successive binary elements of predetermined period (20 milliseconds in the illustrated example) each binary element comprising an oscillation of reference frequency ($f_o$=400 Hz) or at a frequency multiple of $f_o$ (for example 1600 Hz), the oscillation of the different successive binary elements being in phase together, and a significant message comprising 16 binary elements in the illustrated example.

The signal $TP_3$ received and reshaped is applied to a monostable circuit 402 with a recurrence frequency a little less than $t_o=1/fo$ (i.e. 2.5 milliseconds in the illustrated example). The monostable circuit 402 thus releases on a raising edge and drops a little before a raising edge and regenerates a repetitive clock signal $TP_1$ independently of the frequency of the signal $TP_3$.

The formed signal $TP_1$ constitutes a measuring aperture for measuring the frequency received in the signal $TP_3$. Thus, the counter 403 can count the falling edges inside each aperture and in relation to the number (in the illustrated example 1, 4, 5, 6 or 7) which corresponds to the frequencies 400, 1600, 2000, 2400 or 2800 Hz, the binary elements corresponding to the level "1" (when the number of falling edges is greater than 1) are detected and the bits $Z_0$, $Z_1$, relative to an address of zone are regenerated, as a function of the number of falling edges greater than 1 (in the case where the indication of the zone address is transmitted via high level frequencies of different values).

The circuit 407 corresponds to a circuit of binary-decimal decoding. When a counting is completed by the counter 403, if the count corresponds to one of the valid frequencies, nothing happens, if not, the NOR gate 408 causes the production of a clearing signal Ef which clears the contents of the series-parallel conversion shift register of the series binary message BS. Said series-parallel shift register, contained in the circuit 231 of FIG. 3 has a conventional structure and need not be described in more detail.

The divider circuit 406 permits, from the signal $TP_1$ to regenerate a clock signal to the frequency of the binary elements (50 Hz) in the decoder.

On FIG. 7, NOR gate 409 exhibits two inputs VAL and EFEX which are respectively adapted to receive the complementary value of a validating signal and an external erasing signal.

FIG. 9 gives a timing diagram of the circuit of FIG. 7 and shows the shape of the signals in different points of said circuit, and in particular the shape of the input signal reshaped in the input level 401 in order to constitute the signal $TP_3$, the measuring aperture $TP_1$, formed by the monostable circuit 402 from the signal BF modulated in frequency $TP_3$, the shape of the signals at the various terminals of the circuit 403, the shape of the series binary signal BS reconstituted at the output of the flip-flop "D" 405, the shape of the signals $Z_0$, $Z_1$ indicating a zone address reconstituted at the output of flip-flops "D" 404, but which, according to a variant embodiment which only uses a high frequency and a reference frequency for the modulation of the signal $TP_3$ could be included in the series binary signal BS, the shape of the clearing signal Ef, and the shape of the clock signal $CK_1$ timing the series binary signal.

The different circuits shown in FIG. 3 other than the various elements for decoding and regenerating the series binary signal and clock signals can be produced in the conventional way and will not be described in more detail.

Various modifications or additions may of course be made to the device described hereinabove according to the invention without departing from the scope of protection as defined by the accompanying claims.

What is claimed is:

1. An alarm transmission system, comprising a plurality of removable and portable autonomous detection units distributed in a space divided into zones, each unit equipped with detectors capable, when activated of generating electrical signals; transmission means in each detection unit for transmitting the signals generated by said detectors, said transmission means comprising means for coding and radio-transmitting binary information which is frequency modulated on a carrier frequency; and means for permanently maintaining a strict phase relationship between the carrier frequency and the binary information signal transmitted by the transmission means; a plurality of autonomous portable receiving modules for receiving the signal transmitted by said detection units, each said receiving module being equipped with radio-receiving and decoding means as well as signalling or warning means capable of being activated upon receipt of the signals sent by the detection units and a central information-receiving and processing unit equipped with at least one such receiving module.

2. An alarm transmission system comprising:

(a) a set of portable autonomous detection units distributed in a space divided into zones, said units having detectors capable of generating electrical signals upon being activated;

(b) transmission means in each detection unit for transmitting the signals generated by said detectors, said transmission means comprising means for coding and means for radio-transmitting binary information corresponding to said signals in frequency modulated form on a carrier frequency;

(c) a plurality of autonomous portable receiving modules remote from said detection units for receiving the signals transmitted by detection units, each receiving module comprising:

(i) means for receiving said transmitted information;

(ii) means for decoding said transmitted information; and (iii) signalling or warning means which may be activated upon receipt of said transmitted information; and (d) a central information-receiving and processing unit equipped with at least one said receiving module, said receiving modules capable of being temporarily plugged into said central information-receiving and processing unit for direct interaction therewith.

3. The transmission system of claim 1 or claim 2, wherein the frequency modulated binary information signals comprise a first frequency which represents the condition zero and a second frequency which is a whole multiple of the first frequency and represents the condition one.

4. The transmission system of claim 3, wherein two signals corresponding to the condition one transmitted by two detection units situated in two different detection zones are whole multiples of the first frequency, which multiples are different one from the other.

5. The transmission system of claim 1 or claim 2, wherein the transmitted binary information signal comprises at least elements representative of a detection zone, of an address of one station in said detection zone and of a type of alarm signal released, as well as elements for controlling the transmitted signal, and in particular its parity.

6. The transmission system of claim 1 or claim 2, wherein each detection unit comprises at least a volumetric detector of intrusion with Doppler effect.

7. The transmission system of claim 1 or claim 2, wherein each detection unit comprises at least a perimetric detector of intrusion.

8. The transmission system of claim 1 or claim 2, wherein each detection unit comprises at least a fire detector.

9. The transmission system of claim 1 or claim 2, wherein each detection unit comprises means for locking out or timing the switching on of said unit.

10. The transmission system of claim 1 or claim 2, wherein each receiving module is equipped with means for selecting the detection zones which will only respond to the signals transmitted by detection units situated in very specific zones.

11. The transmission system of claim 1 or claim 2, wherein each receiving module is equipped with releasing means for clearing the triggered display or alarm signal.

12. The transmission system of claim 1 or claim 2, wherein each receiving module is in the form of a portable unit which can be plugged into the central unit and includes all the control, display and receiving aerial elements on one face protected by a raised side edge and equipped with a gripping handle.

13. The transmission system of claim 1 or claim 2, wherein the central unit comprises a printer for recording the information received by at least one receiving module plugged in the unit, and means for controlling said information.

* * * * *